United States Patent [19]

Kadota et al.

[11] Patent Number: 4,601,470

[45] Date of Patent: Jul. 22, 1986

[54] ROULETTE GAMING APPARATUS HAVING ELECTRO-MAGNETIC APPARATUS FOR DRIVING A BALL

[76] Inventors: Otomatsu Kadota; Masao Kobayashi, both of No. 5-3, Hirakawacho 2-chome, Chiyodaku, Tokyo, Japan

[21] Appl. No.: 537,451

[22] PCT Filed: Feb. 22, 1983

[86] PCT No.: PCT/JP83/00052

§ 371 Date: Sep. 9, 1983

§ 102(e) Date: Sep. 9, 1983

[87] PCT Pub. No.: WO83/02904

PCT Pub. Date: Sep. 1, 1983

[30] Foreign Application Priority Data

Feb. 22, 1982 [JP] Japan ..... 57-026951

[51] Int. Cl.[4] ..... A63F 5/04

[52] U.S. Cl. ..... 273/142 E; 273/138 A

[58] Field of Search ..... 273/138 A, 142 A, 142 B, 273/142 C, 142 D, 142 E, 142 F, 142 G, 142 H, 142 AA, 142 J, 142 JA, 142 JB, 119 A, 186 B, 129 R; 104/282–284; 40/426; 446/129, 489

[56] References Cited

U.S. PATENT DOCUMENTS

| | | | |
|---|---|---|---|
| 2,493,755 | 2/1944 | Ferrill | 446/129 |
| 2,746,206 | 5/1956 | Hammond | 273/86 B |
| 3,403,908 | 10/1968 | Sheldon et al. | 273/86 B |
| 3,407,749 | 10/1968 | Frig | 104/282 |
| 3,871,301 | 3/1975 | Kolm et al. | 104/282 |
| 4,077,631 | 3/1978 | Tela | 273/142 E |
| 4,337,945 | 7/1982 | Levy | 273/142 E |
| 4,396,193 | 8/1983 | Reinhardt et al. | 273/142 B |

*Primary Examiner*—Richard C. Pinkham
*Assistant Examiner*—MaryAnn Stoll Lastova

[57] ABSTRACT

A roulette game is provided wherein a ball is thrown from a rotary disk onto the ball rotating passageway and is successively subject to actions of the magnetic forces of a series of electromagnets arranged along the ball rotating passageway and gradually increases its speed. After the ball has been thrown, the direction of rotation of the rotary disk is reversed so that the rotating direction of the rotary disk is opposite to the rolling direction of the ball. After a predetermined time period has passed and the electromagnets are deenergized and the rotary disk coasts, the ball loses speed and moves from the rotating passageway onto the rotary disk and is finally caught and stopped in one of a multiplicity of pockets. Therefore, the roulette gaming apparatus gives an actual feeling which is substantially the same feeling as will be obtained when players play an actual roulette game.

6 Claims, 6 Drawing Figures

ROULETTE GAMING APPARATUS HAVING ELECTRO-MAGNETIC APPARATUS FOR DRIVING A BALL

FIELD OF THE ART

This invention relates to a roulette gaming apparatus and, more particularly, to a roulette gaming apparatus which can automatically carry out all of the operations necessary for the roulette game by electrical and mechanical means.

BACKGROUND ART

The game of roulette is played by many people and its outline is as follows. A rotary disk having a number of pockets adapted to receive a ball is manually rotated. A ball is thrown onto a ball rotating passageway associated with the disk. THe ball rolls along the ball rotating passageway in the direction opposite to the direction of rotation of the rotary disk. The ball reduces its rotational speed due to the frictional force and eventually moves toward the center of the disk. Finally it enters one of the pockets provided on the rotary disk. When the rotary disk stops rotating with the ball in the pocket, the number of this pocket is read. Then, a predetermined repayment is made in accordance with the tips or the like that have been preliminarily wagered on the number of the pocket.

All of the operations for the above-described roulette gaming apparatus which has been utilized so far are manually carried out. There has never been provided, heretofore, a roulette gaming apparatus which can automatically perform the above operations and give actual feeling as if players were enjoying an actual roulette game.

DISCLOSURE OF THE INVENTION

It is object of the present invention to provide a roulette gaming apparatus in which all operations necessary for a roulette game are automatically carried out merely by pushing a starting switch by a player. That is to say, this roulette gaming apparatus is constituted in such a manner that (a) a ball is thrown onto a ball rotating passageway (b) this thrown ball is continuously rolled along the ball rotating passageway (c) a rotary disk is rotated in the direction opposite to the moving direction of the thrown ball (d) later the ball is received in one of the pockets formed on the rotary disk and it is then stopped, and (e) the number of this pocket where the ball has stopped is read, thereby performing a predetermined reypayment. The above-mentioned operations are all automatically carried out. In this way the present roulette gaming apparatus can give players an actual feeling as if they were enjoying a real roulette game.

To accomplish the above object, the present invention has a ball made of magnetic material; and ball rotating apparatus comprising (a) a ball rotating member having a ball rotating passageway, (b) a plurality of sensors arranged along the ball rotating passageway for sensing the passing of the ball, (c) a plurality electromagnets, one for each sensors, for applying the magnetic force to the ball in accordance with a signal from the complementary sensor, thereby causing the ball to be rolled in a given direction; and (d) a control circuit for applying a pulse-like current to the selected electromagnet in response to the output of the sensor.

In the roulette gaming apparatus with such a constitution according to the present invention, once the starting switch has been pushed, the rotary disk is first rotated and the ball which had stopped in a pocket on the rotary disk is thrown onto the ball rotating passageway. The ball which has been thrown on the ball rotating passageway is sensed by the sensors arranged along the ball rotating passageway, so that the electromagnets provided corresponding to each sensor are sequentially excited. Thus, the ball is attracted due to the magnetic force and its rolling speed is gradually increased. On the other hand, after the ball has been thrown onto the rotating passageway, the rotary disk is rotated in the direction opposite to rotating direction at the starting time so that the rotating direction of the rotary disk is opposite to the rolling direction of the ball. After only a predetermined period of time, enough for the ball to reach a predetermined maximum speed, has passed, the electric power supply to the electromagnets is turned off, and at about the same time, the rotary disk is raced, namely, inertially rotated. After a while, the rotational speed of the ball gradually reduces and when its rotational radius accordingly decreases, the ball finally drops on the rotary disk. At last, the ball enters one of the pockets and stops therein. At this time, the number of the pocket where the ball has stopped is automatically read and a predetermined repayment is made in accordance with the number of coins which have been preliminarily wagered on its number of the pocket where the ball has stopped.

BEST MODE FOR CARRYING OUT THE INVENTION

Figure 1:
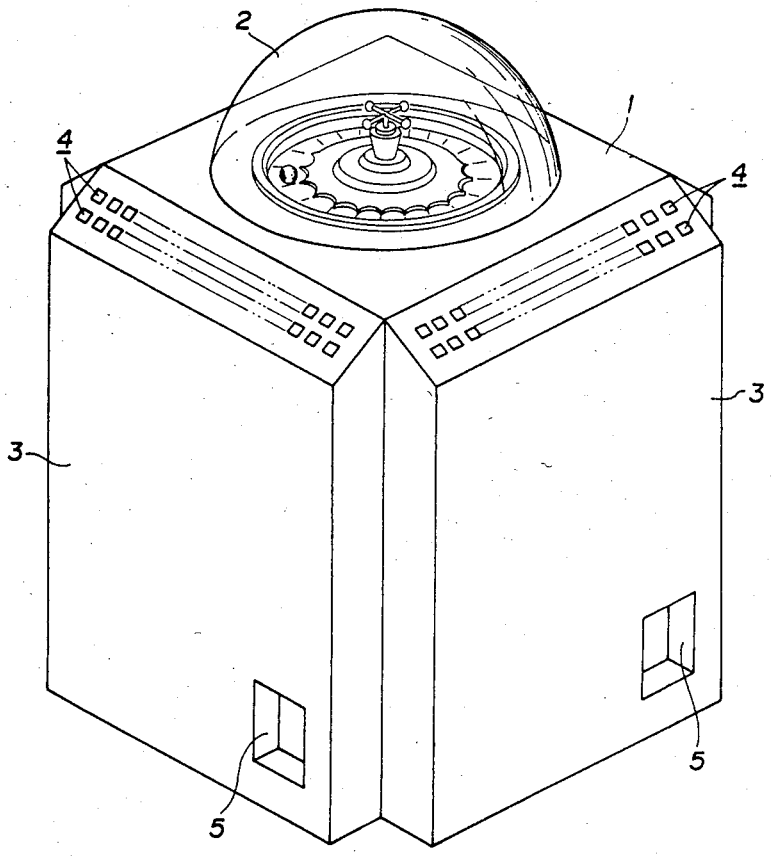
FIG. 1 is an outside perspective view illustrating an embodiment of a roulette gaming apparatus according to the present invention.

In FIG. 1, a main body 1 casing; 2 has a transparent hemisphere-like cover 2 mounted on the upper surface of the main body 1. Operating boxes 3 are mounted on each side surface of the main body 1 a plurality of wager operating buttons 4 are mounted on each operating box 3 to select wager numbers and the number of coins to be wagered. Coin repayment outlets 5 are formed in each operating box 3.

Figure 2:
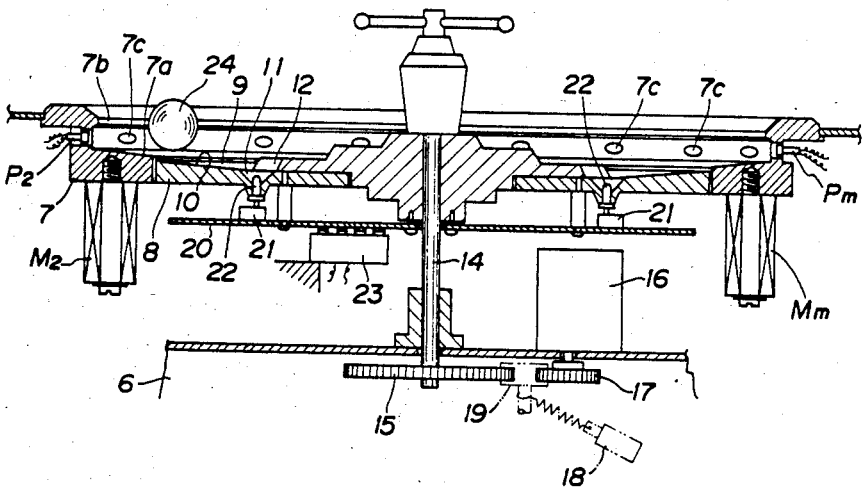
FIG. 2 is a vertical cross sectional view of the main body of the roulette gaming apparatus shown in FIG. 1.

The main body 1 is a box having a square upper surface, which is covered by the transparent hemisphere-like cover 2, thereby allowing the upper portion of the main body shown in FIG. 2 to be seen through the cover. The operating boxes 3 are detachably attached to each side surface of the casing 1.

To play the roulette gaming apparatus, players stand around the main body 1 and push the wager operating buttons 4 on the operating boxes 3 attached to the side surfaces.

Figure 3:
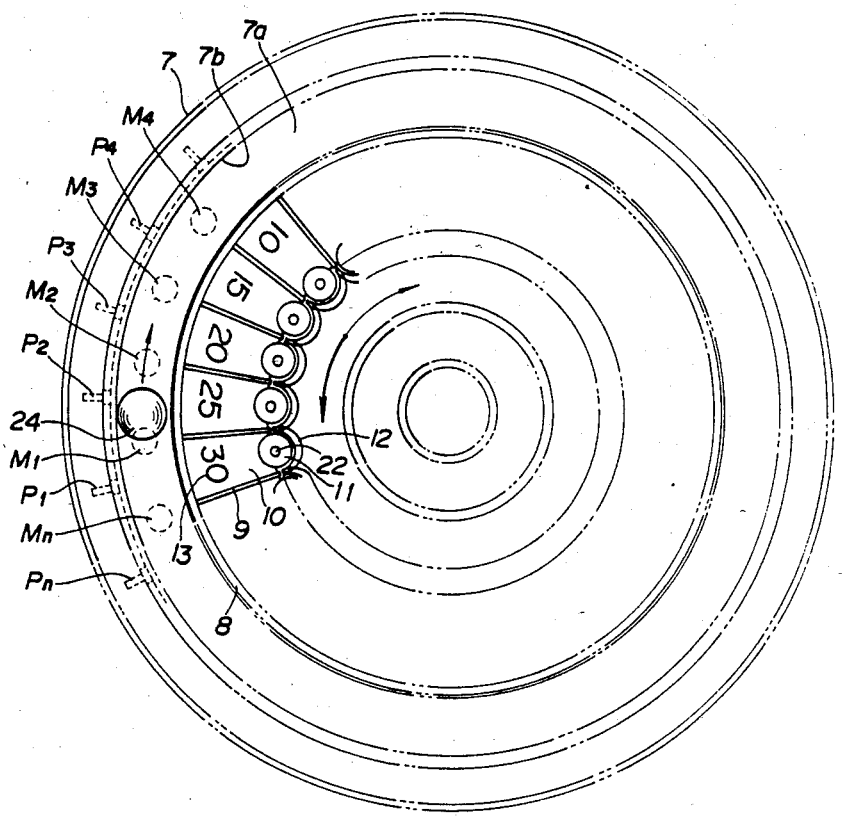
FIG. 3 is a plan view of the main body of the roulette gaming apparatus shown in FIG. 2.

In FIGS. 2 and 3, the reference numeral 6 indicates a base frame; 7 denotes a ball rotating member; *7a* is a ball contact surface; *7b* is a guide wall; *7c* represents window holes; P1, P2, P3, . . . are photo-sensors which are sequentially arranged along the ball rotating passageway; M1, M2, M3, . . . are electromagnets mounted adjacent to and corresponding to the photo-sensors P1, P2, P3, . . . , respectively; 8 is a rotary disk; 9 shows projecting ribs; 10, 10 denote pockets adapted to receive the ball; 11 shows concave portions formed in the pockets 10; 12 shows ball stoppers; 13, 13 show wager numbers written on the surfaces of the pockets 10, 10; 14 is a rotary shaft; 15 is a wheel fixed to the rotary shaft 14; 16 a motor; 17 a driving wheel fixed to the motor shaft; 18 a solenoid; 19 an idler; 20 a circuit board attached onto the rotary shaft 14 so as to rotate integrally with the rotary disk 8; microswitches 21; actuators 22 a brush 23 adapted to come into contact with slip rings attached onto the back surface of the circuit board 20 in order to take out outputs of the microswitches 21; and a ball 24.

The ball rotating member 7 is made of non-magnetic material and horizontally positioned on the upper surface in the main body casing 1 shown in FIG. 1.

The ball rotating member 7 is provided with the annular ball contact surface *7a* which slopes downwardly toward its center and the guide wall *7b* is adapted to come into contact with the ball when the ball it rolls on the contact surface *7a*, thereby guiding the ball. Both the ball contact surface *7a* and the guide wall *7b* define the ball rotating passageway.

The window holes *7c* are formed at regular intervals in the guide wall *7b*, and the reflectivity type photo-sensors P1, P2, P3, . . . are attached to each window hole *7c* so as to face the center of the ball rotating member 7. Thus, the ball 24 rolling on the ball rotating passageway is sequentially detected by the photo-sensors P1, P2, P3, . . . .

The electromagnets M1, M2, M3, . . . are disposed below the ball contact surface *7a* corresponding to each of the photo-sensors P1, P2, P3, . . . so that the respective magnetic pole is close to the ball contact surface *7a*.

The ball rotating apparatus is constituted by the ball rotating member 7, photo-sensors P1, P2, P3, . . . , electromagnets M1, M2, M3, . . . , and a control circuit (which will be shown later by the reference numeral 28 in FIGS. 5 and 6) for sequentially applying a current to each electromagnet in response to the outputs of each of the photo-sensors.

A number of projecting ribs 9 (FIGS. 2 and 3) are radially formed on the rotary disk 8 and the portions partitioned by each projecting rib of the rotary disk 8 correspond to the pockets 10.

The upper surface of the pocket 10 declines slightly from the outer edge portion of the rotary disk 8 to the central portion, and one end of the central portion thereof is formed with a concave portion 11 suitable for holding the ball. The ball stopper 12, of semi-circular shape is formed at one side of the concave portion 11.

The rotary shaft, 14 is rotatably and axially supported by the base frame 6, and the rotary disk 8 is attached to the upper end of the rotary shaft 14 and the wheel 15 is attached to the lower end thereof.

The motor 16 is fixed to the base frame 6, and the driving wheel 17 15 attached to the motor 16.

The idler 19 is coupled to the solenoid 18 and transmits the rotation of the driving wheel 17 to the wheel 15 by contacting the wheel 15 and driving wheel 17 when no current is supplied to the solenoid 18. However, when a current is supplied to the solenoid 18, the idler 19 is detached from the wheel 15 and driving wheel 17, due to the operation of the solenoid 18.

There is one microswitch 21 for each pocket 10. The microswitches are on the rotary disk 8 and are attached to the circuit board 20, and this circuit board 20 is fixed to the rotary disk 8 and rotates integrally therewith.

Each microswitch 21 is attached onto the circuit board 20 at the location corresponding to the concave portion 11 of each pocket 10.

Each of the actuators 22 is vertically and slidably attached to the bottom of the concave portion 11 and its upper end properly protrudes into the concave portion 11 and its lower end abuts on the actuator of the microswitch 21. Therefore, when the ball is held in the concave portion 11, the actuator 22 is depressed, thereby making the microswitch 21 operative.

Figure 4:
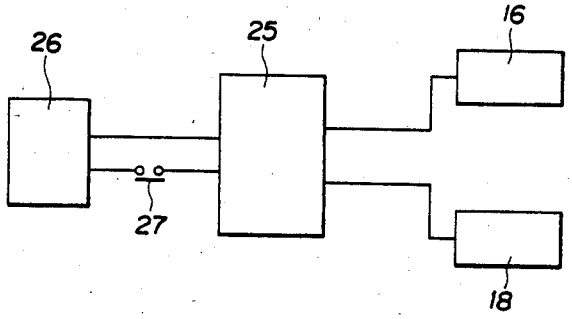
FIG. 4 is a block diagram of a control circuit for instructing the operations of a motor and a solenoid to rotate the rotary disk.

FIG. 4 is a circuit diagram of an apparatus for controlling the motor 16 and solenoid 18 shown in FIG. 2. In this diagram, the reference numerals 16 and 18 denote the motor and solenoid shown in FIG. 2, respectively, and 25 indicates a control circuit, 26 shows a power unit, and 27 represents a starting switch.

The control circuit 25 acts to command the forward and reverse rotations of the motor 16 and the operation of the solenoid 18. When the starting switch 27 is turned on, the control circuit 25 allows the motor 16 to rotate for a predetermined time period; thereafter, it reverses the direction of rotation, and after a predetermined time period has passed, the circuit makes the solenoid 18 operative to detach the idler 19 from the wheel 15 and driving wheel 17.

Figure 5:
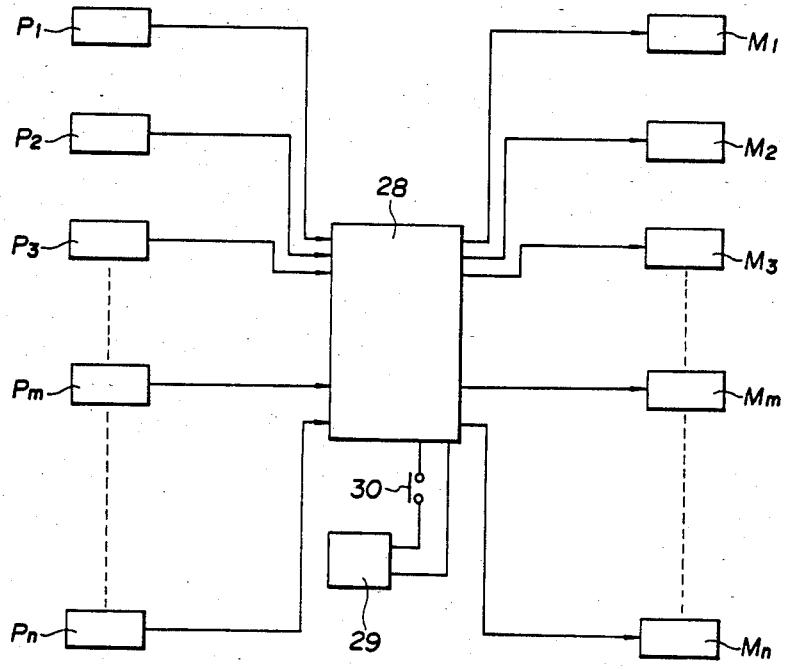
FIG. 5 is a block diagram of a control circuit for applying a pulse-like current to electromagnets corresponding to each sensor in response to the outputs of the sensors provided along the ball rotating passageway.

FIG. 5 shows a block diagram of a control circuit for sequentially magnetizing the electromagnets M1, M2, M3, . . . in accordance with the signals from the photo-sensors P1, P2, P3, . . . arranged along the ball rotating passageway. When the rotary disk 8 has been rotated and the ball 24 has been thrown onto the rotating passageway of the ball rotating member 7, this control circuit makes the ball run on the rotating passageway while further accelerating the ball. In FIG. 5, P1, P2, P3, . . . represent the photo-sensors arranged along the rotating passageway; M1, M2, M3, . . . denote the electromagnets mounted below the ball contact surface *7a*; 28 is a control circuit; 29 is a power unit for supplying a current through the control circuit 28 to the electromagnets M1, M2, M3, . . . ; and 30 is a switch.

The control circuit 28 is constituted in such a manner that it supplies a current to the electromagnet complementary to a given photo-sensor for only a given period of time; for instance, when a signal is given from the photo-sensor P1, a current is supplied to the electromagnet M1, and when a signal is supplied from the photo-sensor P2, a current is supplied to the electromagnet M2, and the like.

Figure 6:
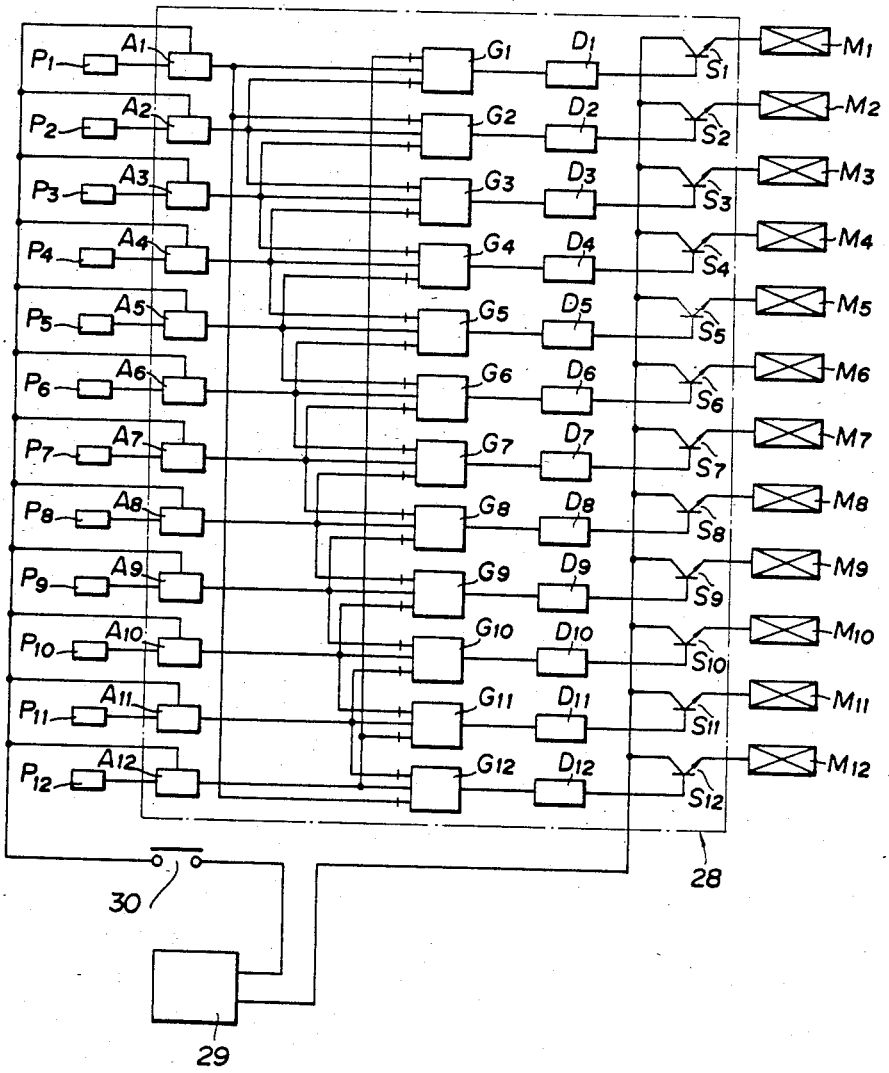
FIG. 6 is a circuit diagram showing the detail of an embodiment of the control circuit shown in FIG. 5.

FIG. 6 shows the detail of an embodiment of the control circuit shown in FIG. 5, and the reference numerals 28, 29 and 30 in FIG. 6 respectively correspond to the components numbered at the same numerals in FIG. 5; that is P1 to P12 indicate the photo-sensors and M1 to M12 represent the electromagnets. In the control circuit 28, the reference characters A1 to A12 denote Schmitt trigger circuits; G1 to G12 show discriminating circuits; D1 to D12 are off-delay circuits; and S1 to S12 are switching devices. In FIG. 6, although only twelve photo-sensors and electromagnets have been drawn to prevent complexity of the drawing, a larger number of such components may be provided actually, and accordingly, there is one Schmitt trigger circuit, one discriminating circuit, one off-delay circuit, and one switching device, and one photo-sensor, for each electromagnet.

The operation of the roulette gaming apparatus according to the present invention shown in the above drawings will be now described in detail hereinbelow.

When the apparatus is stopped, the ball 24 is held in the concave portion 11 of one of the pockets on the rotary disk 8. Now, when the wager operating buttons 4 are pushed to select desired wager numbers, the number of coins to be wagered are tendered, and the starting switch 27 is turned on, the motor 16 starts operating rotating driving wheel 17. This rotation is transmitted through the idler 19 to the wheel 15, so that the rotary disk 8 rotates together with the circuit board 20, for example, clockwise in FIG. 3 at a high speed. At this time, the ball 24 removes from the concave portion 11 due to the centrifugal force and is thrown out of the rotary disk 8 and then the ball moves onto the ball rotating passageway on the ball rotating member 7. At this time, the ball starts rolling in the same direction as the rotating direction of the rotary disk 8.

Immediately after, the rotary disk 8 has thrown the ball, the direction of rotation of motor 16 is reversed in accordance with the command from the control circuit 25, causing the rotary disk 8 to rotate in the direction opposite (counterclockwise in FIG. 3) to the rotating direction at the starting time. Thus, the rolling direction of the ball is opposite to the rotating direction of the rotary disk 8.

In this way, the ball thrown onto the rotating passageway on the ball rotating member 7 is first detected by one of the sensors P1, P2, P3, . . . . Assuming that the ball has been first detected by the photo-sensor P2, the control circuit 28 shown in FIGS. 5 and 6 receives a signal from the photo-sensor P2.

At this time, the control circuit 28 applies a pulse-like current to the electromagnet M2 corresponding to the photo-sensor P2, so that the ball is attracted to the side of the electromagnet M2. Therefore, the ball 24 is slightly accelerated due to the attracting action from the electromagnet M2 in addition to the inertial force when it was thrown from the rotary disk 8.

It is now described hereinafter with respect to the embodiment shown in FIG. 6 the operations of the control circuit 28 for sequentially energizing the electromagnets M1, M2, M3 . . . corresponding to the respective photo-sensors in accordance with the output signals of the photo-sensors P1, P2, P3 . . . .

That is to say, when the starting switch 27 (FIG. 4) is turned on upon starting the play, the switch 30 for making the control circuit 28 operative is automatically and almost simultaneously turned on. At this time, although all of the Schmitt trigger circuits A1, A2, A3, . . . , A12 start operating at once, when the ball 24 thrown from the rotary disk 8 locates at the position shown in FIG. 3 on the ball rotating passageway and is detected by the photo-sensor P2, for example, only the Schmitt trigger circuit A2 corresponding to the photo-sensor P2 generates an output.

In this embodiment, the discriminating circuit G2 is an inhibit gate which permits the output of the Schmitt trigger circuit A2 to pass only only when the Schmitt trigger circuit A2 corresponding to the photo-sensor P2 generates the output and the outputs of the Schmitt trigger circuits A1 and A3 corresponding to the adjacent photo-sensors P1 and P3 are zero. The similar operations are done with respect to the other discriminating circuits G1, G3, . . . , G12. For example, the discriminating circuit G1 is an inhibit gate which permits the output of the Schmitt trigger circuit A1 to pass only when only the Schmitt trigger circuit A1 corresponding to the photo-sensor P1 generates the outputs and the outputs of the Schmitt trigger circuits A12 and A2 corresponding to the adjacent photo-sensors P12 and P2 are zero. For further instance, the discriminating circuit G6 is an inhibit gate which allows the output of the Schmitt trigger A6 to pass only when the outputs of Schmitt trigger circuit A5 and A7 corresponding to the neighboring photo-sensors P5 and P7 are zero.

These discriminating circuits G1, G2, G3, . . . , G12 serve to discriminate whether the signals from the Schmitt trigger circuits A1, A2, A3, . . . , A12 are noises due to the outside light or the like or the true signals. In other words, in case of noises due to the outside light or the like, for example, not only the photo-sensors P2 but also the adjacent photo-sensors P1 and P3 also sense the light simultaneously; consequently, in such a case, the outputs of the Schmitt trigger circuits A1, A2, and A3 are simultaneously input to the discriminating circuit G2. Thus, the output of the Schmitt trigger circuit A2 cannot pass through the discriminating circuit G2.

On the other hand, when the ball 24 has been detected by the photo-sensor P2, the signal passed through the discriminating circuit G2 turns on the switching device S2 through the off-delay circuit D2.

At this time, a pulse-like current flows through the electromagnet M2, so that the ball is strongly attracted in the direction of the electromagnet M2.

These off-delay circuits D1, D2, D3, . . . , D12 are provided to accelerate the ball 24 by still continuing energization to the electromagnets M1, M2, M3, . . . , M12 after the signals from the photo-sensors P1, P2, P3, . . . , P12 have disappeared. The maximum speed of the ball 24 is specified by the delay time which has been built into each of these off-delay circuits D1, D2, D3, . . . , D12. Namely, this delay time period (the output pulse width of the off-delay circuit) has been set so as to be substantially equal to the time required for the ball 24 to pass through the distance between two adjacent photo-sensors when the ball 24 rolls on the ball rotating passageway at a desired maximum speed.

By presetting the delay times of the off-delay circuits in this way, while the ball 24 does not reach the maximum speed, the energization to the electromagnet M2 is cut off before the ball 24 reaches the magnetic pole of the electromagnet M2, so that the ball 24 rolls in the direction of the next photo-sensor P3 due to the inertial force without being reversely attracted to the magnetic pole of the electromagnet M2 after passing through the magnetic pole causing the ball 24 to be detected by the photo-sensor P3. At this time, a pulse-like current is supplied to the electromagnet M3 in the same manner as above, causing the ball 24 to be further accelerated.

The pulse-like energization to the electromagnet M3 is also cut off before the ball 24 reaches the magnetic pole of the electromagnet M3, and the ball 24 further rolls owing to the inertial force and is detected by the next photo-sensor P4. In the same way, the ball is sequentially detected by the photo-sensors P5, P6 and P7 and is attracted by the electromagnets M5, M6 and M7 in the same manner as above, so that the ball rolls on the rotating passageway at a high speed while being gradually accelerated.

In this way, after a predetermined period of time enough for the rotational speed of the ball to reach the predetermined maximum speed has passed, the switch 30 is automatically opened by means of a timer or the like (not shown), thereby stopping energization to each electromagnet. Thereafter, the ball rolls on the ball rotating passageway due to the inertial force.

On the other hand, almost at the same time when the operations of the electromagnets have been stopped, a current is supplied to the solenoid 18 by the command from the control circuit 25 shown in FIG. 4, causing the idler 19 to be separated from the driving wheel 17 and wheel 15. Thereafter, the rotary disk 8 is also rotated due to the inertial force.

When the ball which has been rolling due to the inertial force on the rotating passageway on the ball rotating member 7 gradually loses its rotating speed due to the frictional force, its rotating radius reduced and finally moves onto the rotary disk 8 which is in the raced state. Although the ball rolls while arbitrarily riding over the projecting ribs 9 formed on the rotary disk 8 for a little while, as the rotary disk 8 reduces its speed, the ball is caught by one of the pockets 10. Then, the ball moves in the central direction and is held in the concave portion 11 and stops.

When the ball is held in the concave portion 11, the corresponding actuator 22 is depressed to make the microswitch 21 operative. The output signal of the microswitch 21 is sent to the brush 23 through one of the slip rings attached to the back surface of the circuit board 20. A computing and control circuit (not shown) connected to this brush computes the numbers of the pocket where the ball has stopped. As a result of this, the computing and control circuit outputs a signal indicative of "success" or "failure" for the numbers that have been preliminarily wagered among the wager numbers 13 written on the rotary disk 8. For the wager number of "success," the number of coins to be repayed is computed on the basis of the number of coins wagered on this, wager number of "success" and a repayment mechanism of coins is made operative, so that the repayment of coins is done to the prayer who wagered on the wager number of "success."

In the roulette gaming apparatus according to the present invention, as described above, the ball thrown from the rotary disk onto the ball rotating passageway is successively subject to actions of the magnetic forces of the electromagnets arranged along the ball rotating passageway and gradually increases its speed. After the ball has been thrown, the rotary disk is rotated in the direction opposite to the rotating direction at the starting time, so that the rotating direction of the rotary disk is opposite to the rolling direction of the ball. After a little while, when a predetermined time period has passed and energization to the electromagnet is cut off and the rotary disk is raced, the ball which lost the speed moves from the rotating passageway onto the rotary disk and is finally caught and stopped in one of the pockets and stops therein. Therefore, there is provided a roulette gaming apparatus which can give an actual feeling which is substantially the same feeling as will be obtained when players enjoy an actual roulette game.

The present invention is not limited to the above-described embodiment. For example, as sensors to be provided along the rotating passageway, any sensors can be utilized which can detect the ball made of magnetic material without limiting to the photo-sensors. Various different types of circuits may be used as the control circuit 28 for sequentially energizing each electromagnet in response to the outputs of each sensor. Furthermore, any other sensors may be used in place of the microswitches 21 and actuators 22 as sensor means for detecting that the ball has been caught in the concave portion 11 of a pocket. Moreover, with respect to the components other than these described above, many modifications and variations are possible within the scope of the objects of the present invention. Therefore, the scope of the present invention has to be judged only within the purview of the appended claims without departing from the spirit and intended scope of the invention.

The roulette gaming apparatus according to the present invention is mainly utilized as a kind of game machines to be installed in a game center or a recreational place; however, by making a small-sized roulette gaming apparatus of this type, it can be also used as a roulette gaming toy by which players can enjoy at home.

What is claimed is:

1. A roulette game apparatus comprising: a ball; a ball rotating apparatus having a circular ball rotating passagway; and a rotary disk which is rotatably mounted inside of said ball rotating passageway coaxially therewith and has a plurality of pockets adapted to receive the ball from said ball rotating passageway, wherein said ball is made of magnetic material, said ball rotating apparatus comprising a ball rotating member having said ball rotating passageway, a plurality of sensors arranged along said ball rotating passageway for detecting the passing of said ball, a plurality of electromagnets respectively corresponding to said sensors for applying a magnetic force to the ball in accordance with a signal from the corresponding sensor, a control circuit which applies a pulse-like current to the complementary electromagnet in response to the output of a given sensor, and a rotary disk driving apparatus comprising means which first rotates said rotary disk in the rolling angular direction of said ball, and which later reverses the direction of rotation of said disk and prevents further passage of current to said electromagnets, and which further rotates the rotary disk in said reverse direction after the driving of the ball by said electromagnets and causes the ball to enter one of said pockets.

2. The roulette game apparatus according to claim 1, further comprising sensor means for detecting the ball when the ball has been caught in one of said pockets on said rotaty disk.

3. The roulette gaming apparatus according to claim 2, further comprising a computing and control circuit for computing a repayment amount in accordance with a wagered number and a number of wagered coins in response to an output from said sensor means, and a coin repayment mechanism.

4. A roulette game comprising:

a ball, a rotatable disk having (a) an axis of rotation, (b) an outer circular passageway for said ball, and (c) a series of pockets, each of which is configured to receive the ball; each pocket being located closer to said axis than said outer circular passageway, ball moving means associated with said outer circular passageway for sensing the ball and applying a force to the ball to cause it to move relative to said passageway in a first angular direction, and control means for said rotatable disk, and for said ball moving means, for rotating said rotatable disk in said first angular direction, for activating said ball moving means, and for thereafter reversing the direction of said rotatable disk and deactivating said ball moving means so that the ball will coast in the opposite angular direction to the movement of said rotatable disk and come to rest in one of said pockets.

5. A roulette game as defined in claim 4 in which at least one of said pockets has sensing means for sensing the presence of a ball therein.

6. A roulette game as defined in claim 5, comprising means responsive to said sensing means for indicating a given result from the operation of the game.

* * * * *